US007464774B2

(12) United States Patent
Savignat et al.

(10) Patent No.: US 7,464,774 B2
(45) Date of Patent: Dec. 16, 2008

(54) DRILL BIT AND SYSTEM FOR DRILLING A BOREHOLE

(75) Inventors: Jean-Michel Claude Gaston Savignat, Rijswijk (NL); Djurre Hans Zijsling, Rijswijk (NL)

(73) Assignee: Shell Oil Company, Houston, TX (US)

( * ) Notice: Subject to any disclaimer, the term of this patent is extended or adjusted under 35 U.S.C. 154(b) by 439 days.

(21) Appl. No.: 10/557,324

(22) PCT Filed: May 18, 2004

(86) PCT No.: PCT/EP2004/050834

§ 371 (c)(1),
(2), (4) Date: Nov. 18, 2005

(87) PCT Pub. No.: WO2004/104360

PCT Pub. Date: Dec. 2, 2004

(65) Prior Publication Data

US 2007/0102201 A1 May 10, 2007

(30) Foreign Application Priority Data

May 21, 2003 (EP) ..... 03076533
Oct. 1, 2003 (EP) ..... 03103639

(51) Int. Cl.
*E21B 10/26* (2006.01)

(52) U.S. Cl. ..... 175/385

(58) Field of Classification Search ..... 175/61, 175/385, 386

See application file for complete search history.

(56) References Cited

U.S. PATENT DOCUMENTS 2,016,042 A 10/1935 Lewis ..... 255/1
2,837,314 A 6/1958 Pickard ..... 255/1.6
4,492,276 A 1/1985 Kamp ..... 175/61
5,697,461 A 12/1997 Newton et al. ..... 175/331
5,975,222 A 11/1999 Holte ..... 175/273
6,116,356 A 9/2000 Doster et al. ..... 175/75
6,196,336 B1 3/2001 Fincher et al. ..... 175/101

(Continued)

FOREIGN PATENT DOCUMENTS

WO 03/004824 1/2003

(Continued)

OTHER PUBLICATIONS

Intl Search Report dated Nov. 12, 2004 (PCT/EP2004/050834).

(Continued)

*Primary Examiner*—Jennifer H Gay
*Assistant Examiner*—Daniel P Stephenson

(57) ABSTRACT

A drill bit for drilling a borehole in an object, the drill bit having a central longitudinal axis and comprising:

a pilot section for drilling a pilot bore section of the borehole in the object;

an under-reaming section in a following position with respect to the pilot section, the cutting diameter $D_u$ of the under-reaming section being larger than the cutting diameter $D_p$ of the pilot section;

a connecting shaft extending between the pilot section and the under-reaming section; and a stabilising section located between the pilot section and the under-reaming section, wherein the stabilising section fits inside the pilot bore section and is capable of laterally stabilising the drill bit relative to the object while allowing rotation of at least the pilot section relative to the object.

8 Claims, 3 Drawing Sheets

U.S. PATENT DOCUMENTS

| | | | | |
|---|---|---|---|---|
| 6,494,272 | B1 | 12/2002 | Eppink et al. | 175/57 |
| 6,715,567 | B2 * | 4/2004 | Delgado et al. | 175/61 |
| 2002/0112894 | A1 | 8/2002 | Caraway | 175/385 |
| 2003/0056991 | A1 | 3/2003 | Hahn et al. | 175/61 |
| 2004/0099448 | A1 * | 5/2004 | Fielder et al. | 175/385 |

FOREIGN PATENT DOCUMENTS

| | | |
|---|---|---|
| WO | 03/008754 | 1/2003 |

OTHER PUBLICATIONS

Intl Preliminary Report on Patentability (PCT/EP2004/050856).

* cited by examiner

FIG. 3
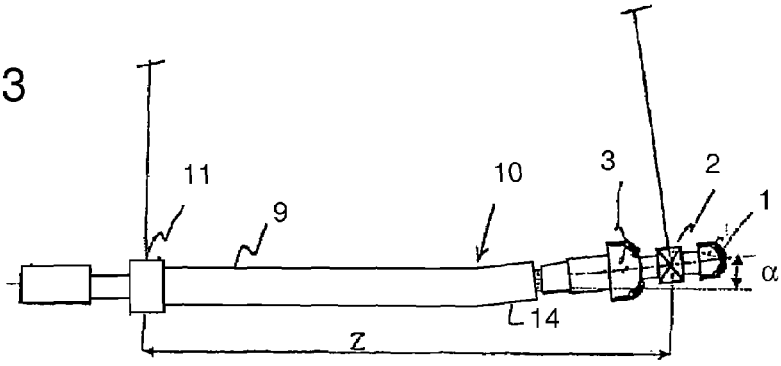
FIG. 4
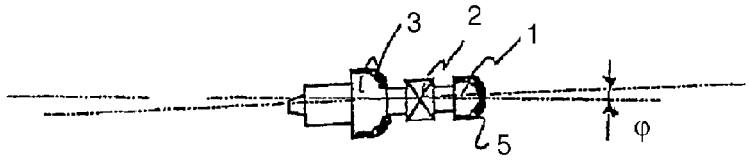
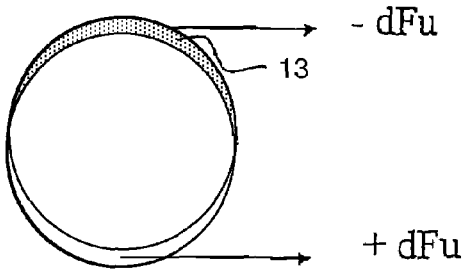
FIG. 5A
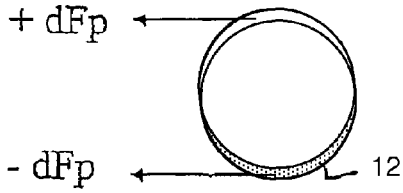
FIG. 5B

DRILL BIT AND SYSTEM FOR DRILLING A BOREHOLE

The present application claims priority of European Patent Application No. 03076533.3 filed May 21, 2003 and European Patent Application No. 03103639.5 filed 1 Oct. 2003.

FIELD OF THE INVENTION

The present invention relates to a drill bit for drilling a borehole in an object, the drill bit generally extending around a central longitudinal axis, and to a system for drilling a borehole in an object.

BACKGROUND OF THE INVENTION

U.S. Pat. No. 4,492,276 describes a known drilling system with a known drill bit. The known drilling system comprises an elongate rigid housing with a main central longitudinal axis to which the known drill bit with its own longitudinal axis is coupled such that its axis is under a non-zero tilt angle with respect to the main central longitudinal axis. The drill bit is mounted in a bearing housing on the elongate housing. The elongate housing is provided with a mud motor that can independently drive the drill bit from the rotation of the drill string. A string stabiliser is provided on the top end of the elongate housing and a bearing housing stabiliser is provided near or on the bearing housing relatively close to the drill bit.

For drilling a straight hole, the bearing housing stabiliser and the string stabiliser are activated to engage with the object where the borehole is being drilled in. At the same time as driving the drill bit, the string is rotated thereby driving the elongate housing into rotation independently from the mud motor action. This is called super-imposed rotation while drilling mode. For allowing the elongate housing to rotate, the string stabiliser and the bearing housing stabiliser are both provided with bearings. In sliding drilling mode, the drill string is not rotated, resulting in a curved borehole being drilled by the drill bit as a consequence of it being mounted under an angle and being laterally supported by the bearing housing stabiliser.

When switching from super-imposed rotary drilling to sliding mode drilling ledges may be created in the hole, holding up the assembly and jeopardizing directional performance. In super-imposed rotary drilling mode hole spiralling may cause an over gauge hole to be drilled which may have a drift diameter smaller than the nominal hole size.

In a significantly over gauge hole the bearing housing stabiliser does not contact the hole wall.

SUMMARY OF THE INVENTION

The present inventions include a drill bit for drilling a borehole in an object, the drill bit having a central longitudinal axis and comprising:

- a pilot section for drilling a pilot bore section of the borehole in the object;
- an under-reaming section in a following position with respect to the pilot section, the cutting diameter $D_u$ of the under-reaming section being larger than the cutting diameter $D_p$ of the pilot section;
  - a connecting shaft extending between the pilot section and the under-reaming section;
  - a stabilising section located between the pilot section and the under-reaming section, wherein the stabilising section fits inside the pilot bore section and is capable of laterally stabilising the drill bit relative to the object while allowing rotation of at least the pilot section relative to the object.

The present inventions include a system for drilling a borehole in an object, the system comprising a drill bit in accordance with the first aspect of the invention, which drill bit is coupled to an elongate extension member whereby the central longitudinal axis of the drill bit extends under a specified included tilt angle greater than zero with respect to the main longitudinal axis of the elongate extension member, whereby the pilot section and the under-reaming section of the drill bit are driven independently from rotational movement of the extension member.

BRIEF DESCRIPTION OF THE DRAWINGS

The embodiments of the invention will be described hereinafter in more detail and by way of example with reference to the accompanying drawings in which:

FIG. 3 schematically shows generally a drilling system;

FIG. 4 explains the drilling bit orientation with respect to the hole in case of sliding mode drilling;

FIGS. 5*a* and 5*b* respectively illustrate the drag forces on the under-reaming section cutters and the pilot section cutters.

DETAILED DESCRIPTION OF THE INVENTION

Figure 1:
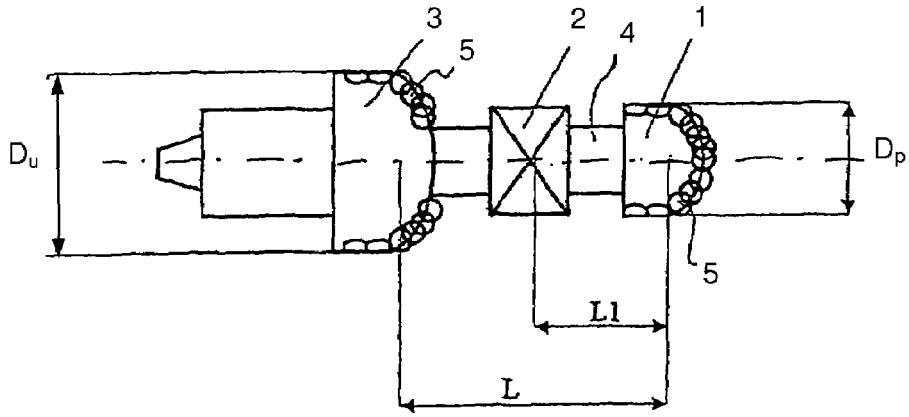
FIG. 1 schematically shows a general cross sectional view of a drill bit according to the invention.

In the Figures like reference numerals relate to like components.

It has been found that by provision of the stabilisation section between the pilot and the under-reaming section, a straight hole can be drilled using super-imposed rotation while drilling mode without any further stabilising means, and a curved hole can be drilled using sliding mode drilling. Thus, at least the bearing housing stabiliser, which causes most problems in the prior art system, can be omitted.

Suitably said rotation comprises rotation about the central longitudinal axis of the drill bit.

Preferably said rotation comprises rotation about an axis extending in lateral direction of the drill bit.

In a preferred embodiment the pilot section is rotatable about said lateral axis relative to the stabilising section.

Also it is preferred that the pilot section is rotatable about the central longitudinal axis relative to the stabilising section. To allow selective locking out of such rotation, suitably the drill comprises locking means for selectively disabling rotation of the pilot section about the central longitudinal axis relative to the stabilising section.

If the drill bit is operated to drill a curved borehole section whereby the drill bit is tilted relative to an upper section of the drill string, there can be a tendency of the drill bit to drill in a direction perpendicular to the plane formed by the intended curved borehole section. Such tendency is caused by an increased drag force at one side of the drill bit due to tilting of the drill bit in the borehole. In order to limit such tendency it is preferred that the stabilising section is positioned such that $L_1$ is larger than $L_2$, wherein $L_1$=the distance between the operative centre of the stabilising section and the operative centre of the pilot section;

$L_2$=the distance between the operative centre of the stabilising section and the operative centre of the under-reaming section.

It is thereby achieved that the increased drag force at one side of the pilot section due to tilting, is substantially cancelled by the increased drag force at one side of the under-reamer section due to tilting, whereby said respective increased drag forces act in mutually opposite directions.

Preferably the cutting diameter ($D_p$) of the pilot section is larger than half the cutting diameter ($D_u$) of the under-reaming section, and wherein the stabilising section is positioned such that $L_2$ is larger than half $L_1$.

More preferably the stabilising section is positioned such that the ratio $L_2/L_1$ is substantially equal to the ratio $D_p/D_u$.

Referring to FIG. 1 there is shown a drill bit comprising a pilot section 1, a lateral stabilisation section 2, an under-reaming section 3 and a connecting shaft 4 extending between the pilot section 1 and the under-reaming section 3 and rigidly connecting these parts. The pilot section 1 and the under-reaming section 3 are provided with cutters 5. These cutters 5 can be of any suitable type. Such a drill bit is useable for drilling a borehole in an object.

Generally, the lateral stabilisation section 2 is arranged to support lateral loads from the drilling system or lateral loads from the drilling action of the pilot section 1 and under-reaming section 3, without cutting rock in the direction of the lateral load. There are various embodiments to achieve this.

In one embodiment, a stabiliser blade arrangement with 360 degrees azimuth coverage is provided, whereby the blades are equipped with wear resistant elements having poor cutting properties in lateral direction. Such wear resistant elements may, for instance, be formed of diamonds set with the flat face towards the wall of the hole. Depending on the axial cross sectional contour of the blade arrangement, the lateral stabilisation section may be axially rotatable inside the borehole with respect to the object, or laterally rotatable, or both. For both lateral and axial rotatability, the contour should have an essentially spherical waist such as a melon-type shape to optimise the sliding performance. For axial rotatability only, the contour may have a straight axial section such that the blades together form an essentially cylindrical surface against the object around the central axis. In the latter case, the leading edge of the blades, which may be the end of the blades closest to the pilot section, may be inwardly tapered to facilitate axial slidability.

The slots between the stabilisation blades enable mud to pass. Alternatively, a number of axial holes may be provided in a full annular bladeless stabiliser arrangement.

In another embodiment, the lateral stabilisation may section includes an outer part 6 which is mounted rotatably with respect to the connecting shaft 4 between the pilot section 1 and the under-reaming section 3. This part may be a sleeve type part which is mounted rotatably around the connecting shaft 4. In this embodiment, the sleeve does not have to rotate in the borehole during drilling, and it only slides in along the hole direction which eliminates any cutting capability. Also in this embodiment, means for allowing passage of mud may be provided.

Preferably, locking means are provided which allows for locking the sleeve against the connecting shaft. In this way, the sleeve can rotate temporarily in the borehole if desired which can be made use of for instance for drilling out a blocking area that may be present in the borehole above the pilot section. When locked, at least the axial rotability of the pilot section with respect to the stabilising section may be disabled so that both are rotated together.

Figure 2:
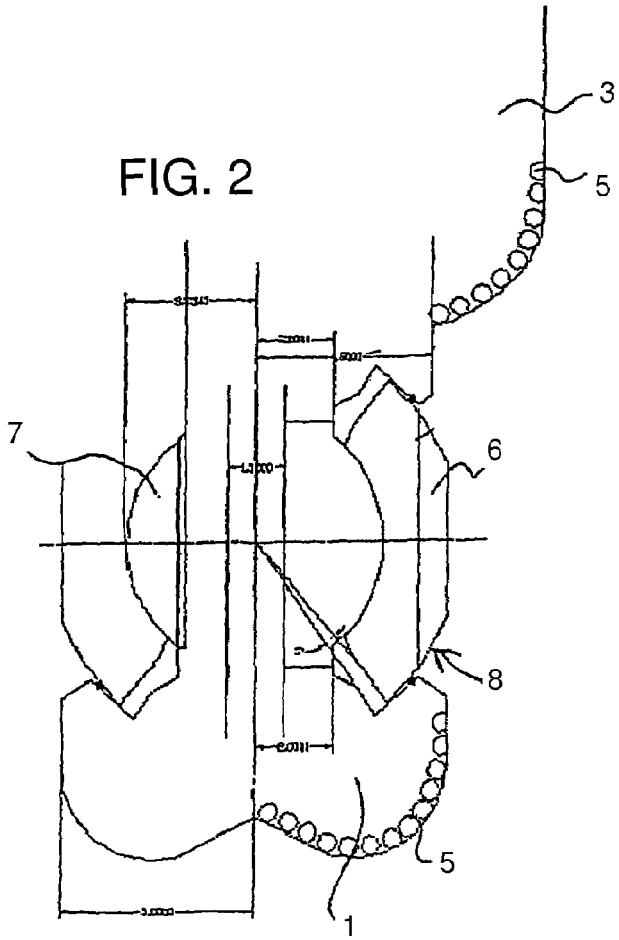
FIG. 2 schematically shows a cross section of an embodiment.

In another embodiment, the outer part is mounted rotatably around a ball joint section in the connecting shaft. This may enables both axial rotatability of the connecting shaft 4 with respect to the outer part and tiltability, or lateral rotatability. FIG. 2 shows an example of the this embodiment, whereby sleeve 6 is rotatably mounted to a ball joint 7 provided in the connecting shaft 4. Sleeve 6 and ball joint 7 interact via any bearing surface allowing for both rotation about the central longitudinal axis of the drill bit and about an axis orthogonal to that.

Optimum sliding performance of the embodiment of FIG. 2 may be achieved for a cylindrical section with a tapered leading edge 8.

As indicated in FIG. 1, the distance between the centers of the cutting structures of the pilot section 1 and under-reaming section 3 is defined as L, and the distance between the centers of the pilot section 1 and the lateral stabilisation section 2 is defined as L1. The gauge of the pilot section 1 is defined as Dp and the gauge of the under-reaming section 3 is defined as Du. In the present example the lateral stabilisation section 2 has the same nominal diameter as the gauge of the pilot section 1, but it may also be under-gauged or over-gauged if desired.

FIG. 3 shows schematically a drilling system including one of the above described drilling bits arranged for achieving a steerability of the drilling system. There is an elongate extension member 9 in the form of a positive displacement motor (PDM), which can be a PDM mud motor. The drill bit is coupled to the elongate extension member 9 via bearing housing 14. The PDM is arranged to drive a drive axis inside a housing. The drive axis (not shown) is rotatable relative to the housing and it is coupled to the drill bit for driving at least the pilot section 1 into rotation relative to the housing. The elongate extension member 9 is provided with an activatable string stabiliser 11. The housing is provided with a knee 10, such that the bearing housing 14, and consequently the drill bit, is coupled to the elongate extension member 9 under an angle $\alpha>0°$. The plane defined by the centre line of the PDM mud motor housing and the centre line of the bearing housing is referred to as the tool face plane.

The drilling system of FIG. 3 is steerable in the following way. In operation, the PDM rotates the pilot section 1 and the under-reaming section 3 of the drill bit via the drive axis inside the housing. When the drill string is lowered without rotation, the drilling assembly engages in a sliding mode with the earth formation to be drilled. As a result of the knee 10 in the drilling system, the drill bit drills under an angle with respect to the main axis of the elongate extension member 9, as a result of which the borehole will proceed in a under an angle with the elongate extension member. At the same time the stabiliser 11 is sliding down the under-reamed section of the borehole. The overall result of the movement of the drilling assembly is that the borehole progresses in curved fashion. This is referred to a sliding mode drilling. When, on the other hand, the extension member and the housing are rotated essentially about the main longitudinal axis for instance by rotationally driving the drill string, the drill bit will be forced into a wobbling motion whereby the lateral stabiliser 2 acts as a wobbling centre. This causes super imposed rotary drilling and is referred to as rotation while drilling mode. On average, the drilling system will proceed in a straight path because there is no preferential direction for the knee 10.

The stabiliser 11 may be an expandable stabiliser of which the diameter may be increased compared to that while running the assembly in the hole, or a fixed stabiliser, such as a wear pad, to function as a support point for the drilling assembly. For facilitating the rotating while drilling mode, the pilot section 1 may be laterally rotatable, or tiltable, with respect to the lateral stabiliser 2. In particular, an embodiment wherein the pilot section 1 is laterally rotatable with respect to the stabilising section 2 ensures proper wobbling. In the latter case, the lateral stabiliser 2 is operative in sliding mode with respect to the earth formation.

In the system described above, the bearing housing is fixedly coupled to the elongate extension member. Alternatively, the drilling bit of the invention can be run on a rotary steerable drilling system whereby the drill string rotates continuously but the direction of the knee or the tool face can be operated in rotating mode or in fixed mode. In fixed mode, the elongate extension member rotates with respect to the knee whereby the azimuthal direction of the knee with respect to the borehole in the object is fixed to point the bit in a fixed direction. In rotating mode, the knee rotates together with string on command. The latter causes the wobbling of the bit and thus straight hole drilling.

The radius of curvature, or build-up rate, of the hole drilled by the drilling system is a function of the governing system parameters. The build-up rate of the assembly in sliding drilling mode is governed by the following parameters, assuming the lateral stabilisation section of the bit does not have any lateral drilling ability:

- the bend-angle of the bearing housing relative to the stator housing of the PDM mud motor; and
- the along hole distance between the lateral stabilisation section 2 of the bit and the string stabiliser 11 above the PDM mud motor.

Any clearance of the string stabiliser 11 above the PDM mud motor will increase the build-up rate, and the fact that the bit has to be slightly tilted in the hole are two second order parameters with opposite effects on the build-up rate and are not considered any further here.

When the drilling system is drilling in sliding mode, as explained above, the bit may be slightly tilted in the hole to ensure a circular arc is drilled. The bit hinges about the stabilising section 2. The impact of this on the drilling forces deviations compared to those representative for straight drilling are illustrated in FIGS. 5*a* and 5*b* on the basis of the drilling of a build-up section.

To achieve a build-up section, the center line of the bit has to make a small tilt angle (ϕ) with the center line of the hole at the depth of the bit (see FIG. 4). This implies that the workload of all the pilot section cutters 5 located below the center line of the bit is reduced by a certain amount represented by section 12 of the small circle in FIG. 5*b*. The reduction in total drag force of these cutters, dFp, is pointing left when viewing along the bit center line in the drilling direction. Similarly the work load of all the cutters above the center line of the pilot section will increase by a small amount resulting in a resulting drag load increase of +dFp also pointing left (see FIG. 5*b*).

The under-reaming section 3 faces similar deviations in total drag load above and below the centre line, as is illustrated by section 13 in FIG. 5*a*.

These deviations can cause the drill bit to walk, which means that the drilling system does not drill a curved trajectory in one azimuthal plane but that the drill bit has a tendency to deviate in a direction perpendicular to this tool face plane. In that case the bit has a tendency to change the azimuth of the hole.

The deviations can be quantified as follows:

$$dFp=K1p\times\phi\times L1\times Dp \quad (1)$$

wherein

K1p is a constant representing the effect of cutting structure of pilot section 1 and formation drillability on cutting loads;

ϕ is the tilt angle of the bit in the hole being defined as the angle between the center line of the bit and the hole at the location of the centre of the stabilisation section;

L1 is the distance between centre of the pilot cutting structure and the stabilization section 2; and Dp is diameter of pilot section 1; and $$dFu=K1u\times\phi\times(L-L1)\times Du \quad (2)$$

wherein

K1u is a constant representing the effect of cutting structure of under-reaming section 3 and the formation drillability on cutting loads;

L is the distance between the center of the pilot cutting structure and the under-reaming cutting structure as indicated in FIG. 1; and Du: diameter of the hole.

The walking tendency of the bit is eliminated in case the following equilibrium applies:

$$dFp=dFu \quad (3).$$

Formulas (1) and (2) are considered adequate representations because the drag load acting on the respective drill bit sections increases with increasing cutting depth, and because the cutting depth is substantially linearly dependent on the diameter of the respective drill bit section (i.e. pilot section or under-reamer section) and the tilt angle ϕ of the drill bit in the borehole.

This implies for the location of the lateral stabilization section 2:

$$L/L1=1+K1u/K1p*Dp/Du \quad (4).$$

Assuming identical cutting processes for pilot section 1 and under-reaming section 3, this relation simplifies to:

$$L/L1=1+Dp/Du \quad (5).$$

Thus, it is preferred that the geometry of the drilling bit is sufficiently close to this ideal relationship, with the advantage that the system drills only in the tool face plane.

When the "no walk" criterion is met as is discussed above, a minimum wear-and-tear criterion in azimuthal direction is also met because the bit is force-balanced in this direction as per equation (4).

In the vertical plane the bit should also be force balanced while being tilted in the hole. The design equation that achieves this is presented following the same approach as before for the "no walk" criterion.

Figure 6:
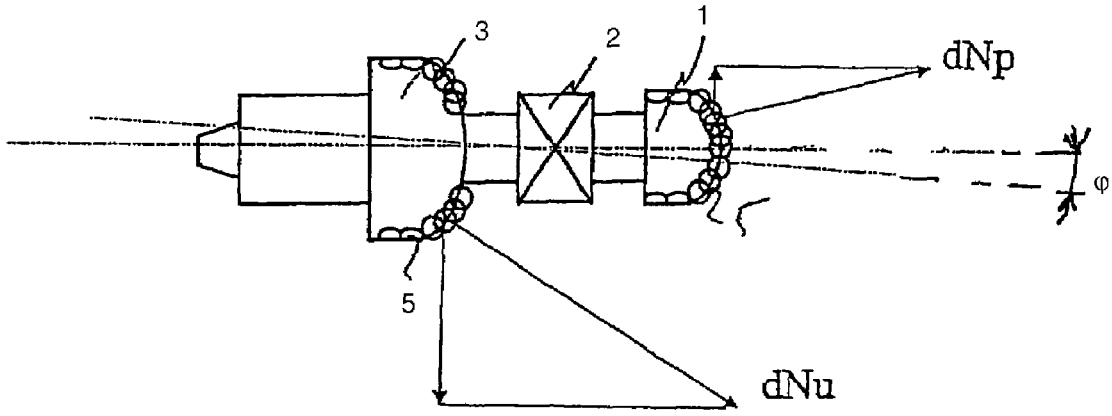
FIG. 6 illustrates the geometry of the drilling system for minimising the wear and tear on the lateral stabilisation section of the drill bit.

Referring now to FIG. 6, dNu represents the total normal force increase acting on the cutters below the center line of the under-reaming section 3 of the bit associated with dFu in FIG. 5*a*. The same relation can be defined for the pilot section 1 between dNp and dFp. These relations can be expressed as:

$$dNu=K2u(\text{cutting structure})\times dFu$$

$$dNp=K2p(\text{cutting structure})\times dFp \quad (6)$$

The forces dNu and dNp apply at an angle with the centerline of the bit. This angle is governed by the profile of the bit section. The lateral component of these forces can be expressed as:

$$dNul=dNu\times K3u(\text{cutting profile})$$

$$dNpl=dNp\times K3p(\text{cutting profile}) \quad (7)$$

The minimum wear-and-tear criterion in the vertical plane, which is the tool face plane, is met when $$dNul=dNpl \quad (8),$$

and assuming that equation (3) is met, this yields:

$$K2u \times K3u = K2p \times K3p \quad (9).$$

In case identical cutting structures in terms of, for instance, type of cutting elements and back rake angles, are applied in the pilot section 1 and under-reaming section 3, this requirement simplifies to $$K3u=K3p \quad (10).$$

The parameters K1, K2, K3 for under-reaming section 3 and pilot section 1 can be calculated for a specific bit design using bit force calculation software packages.

Advantages include one or more of the following:

large lateral drilling forces acting on the PDM mud motor bearing section are eliminated;

in super-imposed rotary drilling mode the hole is only marginally over gauge (in the order of millimeters), so that consequently the ledges formed in the hole when switching from rotary to sliding drilling mode are minimal;

spiralling will not occur because of the small distance between the lateral stabilisation section and the cutting elements of the bit hole, resulting in a smoother borehole;

the drilling system allows for longer bits without significantly affecting the directional drilling characteristics of the system;

the drilling system provides a reliable directional drilling technique even for drilling operations involving a large under-reaming component; and large lateral loads on the bearings of a steerable PDM mud motor are eliminated.

The embodiments described above serve as non-restrictive examples only. Some embodiments of the invention also embraces roller cone drilling bits and hybrid drilling bits having a drag pilot section and a roller cone under-reaming section or vice versa.

We claim:

1. A drill bit for drilling a borehole in an object, having a central longitudinal axis and comprising:

a pilot section with a cutting diameter $D_p$ for drilling a pilot bore section of the borehole in the object;

an under-reaming section with a cutting diameter $D_u$ in a following position with respect to the pilot section, the cutting diameter $D_u$ of the under-reaming section being larger than the cutting diameter $D_p$ of the pilot section;

a connecting shaft extending between the pilot section and the under-reaming section;

a stabilising section located between the pilot section and the under-reaming section, wherein the stabilising section fits inside the pilot bore section and laterally stabilizes the drill bit relative to the object while allowing rotation of at least the pilot section relative to the object, wherein the stabilising section and the pilot section are substantially concentrally arranged; and wherein the pilot section is rotatable about the central longitudinal axis relative to the stabilising section;

further including a locking means for selectively disabling rotation of the pilot section about the central longitudinal axis relative to the stabilising section.

2. The drill bit of claim 1, wherein said rotation comprises rotation about the central longitudinal axis of the drill bit.

3. The drill bit of claim 1, wherein said rotation comprises rotation about an axis extending in lateral direction of the drill bit.

4. The drill bit of claim 3, wherein the pilot section is rotatable about said lateral axis relative to the stabilising section.

5. The drill bit of claims 1, wherein the pilot section and the under-reaming section are rigidly connected to each other via the connecting shaft.

6. The drill bit of one of claim 1, wherein the stabilizing section is positioned such that $L_1$ is larger than $L_2$, wherein $L_1$=the distance between the operative center of the stabilising section and the operative centre of the pilot section;

$L_2$=the distance between the operative center of the stabilising section and the operative center of the under-reaming section.

7. The drill bit of claim 6, wherein the cutting diameter ($D_p$) of the pilot section is larger than half the cutting diameter ($D_u$) of the under-reaming section, and wherein the stabilising section is positioned such that $L_2$ is larger than half $L_1$.

8. The drill bit of claim 6, wherein the stabilising section is positioned such that the ratio $L_2/L_1$ is substantially equal to the ratio $D_p/D_u$.

* * * * *